US006156425A

United States Patent [19]

Bouquerel et al.

[11] Patent Number: 6,156,425

[45] Date of Patent: Dec. 5, 2000

[54] POLYESTER FILAMENTS AND METHOD FOR MANUFACTURING SAME

[75] Inventors: Franck Bouquerel; Philippe Lapersonne, both of Lyons; Eric Roche, Luzinay, all of France

[73] Assignee: Rhone-Poulenc Fibres et Polymeres S.A., Coubevoie Cedex, France

[21] Appl. No.: 09/214,312

[22] PCT Filed: Jul. 3, 1997

[86] PCT No.: PCT/FR97/01193

§ 371 Date: May 25, 1999

§ 102(e) Date: May 25, 1999

[87] PCT Pub. No.: WO98/01609

PCT Pub. Date: Jan. 15, 1998

[30] Foreign Application Priority Data

Jul. 4, 1996 [FR] France ..... 96 08566

[51] Int. Cl.[7] ..... D01F 6/62

[52] U.S. Cl. ..... 428/364; 428/395

[58] Field of Search ..... 428/364, 395

[56] References Cited

U.S. PATENT DOCUMENTS

| | | | |
|---|---|---|---|
| 2,556,295 | 6/1951 | Pace . | |
| 2,615,784 | 10/1952 | McClellan . | |
| 4,098,864 | 7/1978 | Morris . | |
| 5,238,740 | 8/1993 | Simons et al. | 428/364 |
| 5,558,935 | 9/1996 | Tanaka et al. | 428/395 |

FOREIGN PATENT DOCUMENTS

| | | |
|---|---|---|
| 0 413 327 | 8/1990 | European Pat. Off. . |
| 1 347 985 | 4/1964 | France . |
| 2 001 995 | 10/1969 | France . |
| 2 248 342 | 5/1975 | France . |
| 2 274 711 | 1/1976 | France . |
| 88 03185 | 5/1988 | WIPO . |
| 89 03437 | 4/1989 | WIPO . |

OTHER PUBLICATIONS

Database WPI, Section Ch, Week 8533, Derwent Publications Ltd., London, GB; Class A23, AN 85–200368, XP002028124 & JP 60 126 317 A (Gosen KK), Jul. 5, 1985, see abstract.

Database WPI, Section Ch, Week 8508, Derwent Publications Ltd., London, GB, Class A23, AN 85–046075, XP00208125 & JP 60 002 710 A (Unitika KK), Jan. 9, 1985, see abstract.

*Primary Examiner*—Newton Edwards
*Attorney, Agent, or Firm*—Burns, Doane, Swecker & Mathis, L.L.P.

[57] ABSTRACT

The invention concerns polyester filaments and method for manufacturing same. More particularly it concerns a filament made of glycol ethylene polyterephtalate or polynaphtalate having high mechanical properties, and a method for stretching polyester filaments. It is obtained by a stretching process comprising two steps including a first step in which a low stretching ratio is applied, to cause minimal crystallization of the polymer and, a second step with a high stretching ratio. The global stretching ratio can reach values higher than 12. The filament has in particular an expanded elastic range that enables the improvement of its useful properties, for instance for manufacturing screen printing grids.

11 Claims, 2 Drawing Sheets

POLYESTER FILAMENTS AND METHOD FOR MANUFACTURING SAME

The present invention relates to filaments made of semicrystalline polyester and to a process for manufacturing such a filament.

The subject-matter of the invention is more particularly a filament made of semicrystalline polyester, such as a poly(ethylene glycol terephthalate) or poly(ethylene glycol naphthalate), exhibiting high mechanical properties and a process for drawing these filaments.

BACKGROUND OF THE INVENTION

Filaments, such as monofilaments or multifilament yarns, made of polyester are generally obtained by melt spinning a polyester and the monofilament obtained is subsequently subjected to a drawing operation, in order to orient the structure of the polyester and to obtain high mechanical properties, such as, for example, the Young's modulus or the tenacity. The drawing operation is carried out either in a single stage or in several stages. The total draw ratio applied is generally of the order of 6.

However, for applications of monofilaments as, for example, reinforcing components for straps, conveyor belts or tires or for the production of felts for paper machines or fabrics for screen printing, and the like, it is advantageous and desired to obtain still higher mechanical properties.

Current processes for the manufacture of monofilaments are limited because it is impossible to apply high draw ratios to the polyester filament without causing the latter to break; the maximum ratios are thus of the order of 7 to 8.

In fact, numerous processes for drawing polyester monofilament have been disclosed in the literature. Thus, mention may be made, by way of example, of Japanese Patent J02091212, which discloses a two-stage drawing operation, the first drawing operation being applied according to a ratio of between 3.5 and 5 and an overdrawing operation subsequently being applied. The overall draw ratio is then between 5 and 5.8.

U.S. Pat. No. 3,998,920 also discloses a two-stage drawing process with a first draw ratio of between 4 and 6 and a total draw ratio of between 6 and 7.5.

Drawing processes equivalent to those described above are also made known in U.S. Pat. Nos. 3,963,678, 4,009,511, 4,056,652, 5,082,611 and 5,223,187.

Furthermore, in the usual industrial processes, the drawing operation is generally carried out in a single stage, optionally followed by an overdrawing stage and/or by a relaxation stage.

The monofilaments obtained by these drawing processes exhibit a high level of mechanical properties, for example a breaking stress of the order of 600 MPa and an elongation at break of the order of 30%.

These filaments exhibit a stress at 4% elongation of less than 500 MPa and a small elastic range generally corresponding to an elongation of less than 4% and to a stress of less than 300 MPa.

DETAILED DESCRIPTION OF PREFERRED EMBODIMENTS

One of the aims of the invention is to provide a novel polyester filament exhibiting an even higher level of mechanical properties and a manufacturing process, more particularly a drawing process, which makes it possible to obtain such filaments.

The subject-matter of the invention is in particular a drawn polyester filament obtained by melt spinning exhibiting an elastic range for which the stress/elongation limits are respectively greater than 300 MPa and 4%, preferably greater than 600 MPa and 5%.

The limits of the elastic range correspond to the abscissa and ordinate of the point of the stress=f(elongation) curve which departs by 10% from the elastic straight line defined by stress=modulus of elasticity×elongation.

This stress=f(elongation) curve is prepared from an Instron® measuring device with a sample with a length of 50 mm at a temperature of 25° C. and a relative humidity of 50%. The rate of elongation is 50 mm/min.

Stress should be understood as meaning the ratio of the force (unit: N) to the initial cross-section of the filament (unit: $m^2$).

Filament should be understood as meaning filaments exhibiting a significant cross-section, for example a diameter of greater than 20 $\mu$m, and generally used individually or in combination with other filaments for the preparation of twists or cords; these filaments are generally known as monofilaments. Filament also means filaments with a small cross-section or with a small count, which can be less than 1 dtex, used in the form of yarns, slivers or rovings. In this case, the filaments are combined under the die to form a yarn or a roving which will be subjected to the drawing process in accordance with the invention. These yarns or tows are used in particular in the textile field or as industrial yarns for, for example, reinforcing materials, such as tires, or for the manufacture of fibres for non-woven uses, stuffings, manufacture of spun yarns for fibres, flock, for example.

The filaments of the invention, after drawing, can be subjected to a relaxation or heat-setting in order to obtain a desired shrinkage value, the values characterizing the elastic range or the stress at 5% elongation then being modified. However, the improvement obtained with regard to the properties of the drawn filaments is also observed with regard to the heat-set or relaxed filaments. Thus, such filaments exhibit a higher breaking stress than known filaments for an identical elongation at break.

According to another characteristic of the invention, the polyester filaments exhibit a non-instantaneous creep, under a force of 200 MPa after 2500 s at 25° C., of less than 1%, preferably of less than 0.5%. This non-instantaneous creep, measured at 160° C. under a stress of 100 MPa, is less than 2%, advantageously less than 1%, after 600 s.

According to another preferred characteristic of the invention, the drawn polyester filament exhibits a stress at 5% elongation, also known as F5, of greater than 350 MPa.

The stress at 5% elongation represents the stress applied to the filament in order to obtain an elongation of 5% of the initial length.

According to another characteristic of the invention, the drawn polyester filament exhibits a Young's modulus of greater than 9 GPa, preferably of greater than 12 GPa, and a breaking stress of greater than 700 MPa for an elongation at break of greater than 25%.

This filament is made of polyester, such as a poly(ethylene terephthalate), poly(butylene terephthalate), poly (trimethylene terephthalate) or poly(ethylene dinaphthalate), or of copolyesters, such as, for example, copolyesters comprising at least 80% of ethylene glycol terephthalate units, it being possible for the other diacids or diols to be, for example, isophthalic acid, p,p'-diphenyldicarboxylic acid, naphthalenedicarboxylic acid, adipic acid or sebacic acid. Poly(ethylene terephthalate) is the preferred resin.

The filaments of the invention exhibit high mechanical characteristics with respect to those of known polyester filaments and in particular a markedly greater elastic range.

These high properties are very advantageous, in particular when the filament is used as a monofilament. Such a monofilament can be employed for the preparation of a surface, such as, for example, conveyor belts, or in combination with one or more monofilaments for the preparation of twists or cords.

These filaments, exhibiting a greater elastic range and a higher breaking stress, are also used in the field of textile and industrial yarns because it will be possible to exert a greater stress without risk of deformation, for example in the weaving or screen printing industries.

Another subject-matter of the invention is a process for the manufacture of a polyester filament which consists in drawing one or more filaments, obtained by melt spinning a polymer through a die, and cooling, in order to obtain a filament exhibiting a low degree of crystallinity of less than 5%, and then optionally winding the filaments obtained.

The process of the invention consists in subjecting the filaments obtained by spinning to a drawing operation comprising the following stages:

in a first stage, in heating the filament to a first temperature $T_1$ and in applying a draw ratio $\lambda_1$ of between 1.3 and 2.5, in order to bring about an increase in the birefringence $\Delta n$ such that the latter is at most equal to 15% of the intrinsic birefringence of the polymer $\Delta n_0$ defined below, preferably at most equal to 5%, and a final degree of crystallinity of less than 5%, then, in a second stage, in heating the filament to a second temperature $T_2$ and partially drawing the filament according to a draw ratio $\lambda_2$ which is greater than $\lambda_1$ and specified in order to obtain the desired characteristic of elongation at break.

In this second drawing stage, the draw ratio can be equal to the maximum ratio which can be endured by the said filament.

Thus, the draw ratio applied in the second stage is generally greater than 3 but can reach values of 5 or 6.

The intrinsic birefringence $\Delta n_0$ is equal to 0.23 for a poly(ethylene glycol terephthalate) according to Dumbleton (J. Pol. Sci., A2, 795, 1968).

The optical birefringence $\Delta n$ is measured with a polarizing optical microscope equipped with a compensator of Berek type. In the case of a filament with a large diameter, a partial additional compensation is achieved using calibrated birefringence films made of the same material. The birefringence of these films is itself measured with the same polarizing microscope equipped with a compensator of Berek type.

The drawn filament can optionally be heat treated in order to set its structure or to obtain a specific degree of relaxation.

According to another preferred characteristic of the invention, the first stage of the drawing process must not bring about an increase in the degree of crystallinity of the polymer or only a very slight crystallization of the polymer, in order to obtain a final degree of crystallinity of less than 2%.

The degree of crystallinity is deduced from the value of the relative density of the filament according to the formula:

$$\text{Relative Density}=\text{Amorphous Relative Density}\times(1-\text{Degree of Crystallinity})+\text{Crystal Relative Density}\times\text{Degree of Crystallinity}$$

According to Daubeny, Bunn and Brown (Proc. Roy. Soc. London, 1954, 226, 531), the Amorphous Relative Density and Crystal Relative Density values for poly(ethylene glycol terephthalate) are 1.335 and 1.455 respectively.

The value of the relative density of the filament is measured using a Davenport® gradient column. In the case of poly(ethylene glycol terephthalate), the two liquids are tetrachloromethane and toluene.

According to one characteristic of the invention, the draw ratio applied in the first stage is advantageously between 1.4 and 2.0, in order to obtain a birefringence of the material at most equal to 2% of the intrinsic birefringence of the polymer.

According to yet another characteristic of the invention, the maximum draw ratio which can be applied to the predrawn filament during the second drawing stage is advantageously between 4 and 8.

Thus, the overall draw ratio applied to the filament can be greater than 8 and can reach values of 12 to 15, ratios inaccessible according to a single-stage drawing process or a process with an overdrawing operation.

The temperature $T_1$ of the first drawing stage is advantageously greater by 30° C. than the glass transition temperature of the polymer, Tg. For example, for poly(ethylene glycol terephthalate) (Tg=75° C.), this temperature $T_1$ is advantageously between 105° C. and 160° C.

The temperature $T_2$ of the second drawing stage can be the same as or different from $T_1$.

The filaments obtained by the process of the invention can have diameters varying within a very broad range from a few microns up to a few millimeters.

The polyesters which are suitable for the invention are semicrystalline polyesters which make it possible to obtain filaments, after rapid cooling at the die outlet (cooling comparable to a quenching of the material), exhibiting a low degree of crystallinity, for example of less than 5%. In other words, the polyesters which are suitable for the invention are preferably polymers exhibiting slow rates of crystallization.

Mention may be made, by way of preferred thermoplastic polymers of the invention, of polymers of polyester type, such as a poly(ethylene glycol terephthalate), poly(butylene terephthalate), poly(trimethylene terephthalate) or poly (ethylene dinaphthalate), polymers of the polyolefin type, such as syndiotactic polystyrene, or copolyesters, such as, for example, copolyesters comprising at least 80% of ethylene glycol terephthalate units, it being possible for the other diacids or diols to be, for example, isophthalic acid, p,p'-diphenyldicarboxylic acid, naphthalenedicarboxylic acid, adipic acid or sebacic acid.

The preferred polyester of the invention is poly(ethylene glycol terephthalate), as defined above.

The spinning of the thermoplastic polymer is carried out according to known spinning processes through a die and then a cooling of the filaments with air or water. The filaments are generally introduced directly into the drawing device.

However, without departing from the scope of the invention, the filaments can, in particular when the filaments have been combined in the form of rovings or yarns, be wound onto a bobbin or deposited in the roving form in a container before being fed to the drawing device.

The filaments, thus spun, are introduced into a drawing device comprising two drawing stages or two drawing assemblies mounted in series on the path of the filament.

Each drawing assembly advantageously comprises appropriate and conventional heating means. These heating means are, for example, induction heating, convection heating, radiation heating or heating means employing a hot fluid, such as hot air or superheated steam, or a heating liquid. Tt is also possible to use a heating roller as the first roller of each drawing assembly or to install these devices in heated chambers at a regulated temperature.

The draw ratio applied in the second drawing stage of the process of the invention is advantageously the maximum draw ratio which can be applied to the filament. The polymer at least partially crystallizes during this stage. The filament obtained exhibits a birefringence $\Delta n$ in the region of the intrinsic birefringence $\Delta n_0$ of the polymer.

Other aims, advantages and details of the invention will become more clearly apparent in the light of the examples given solely by way of indication and of illustration and with reference to the appended figures:

Figure 1:
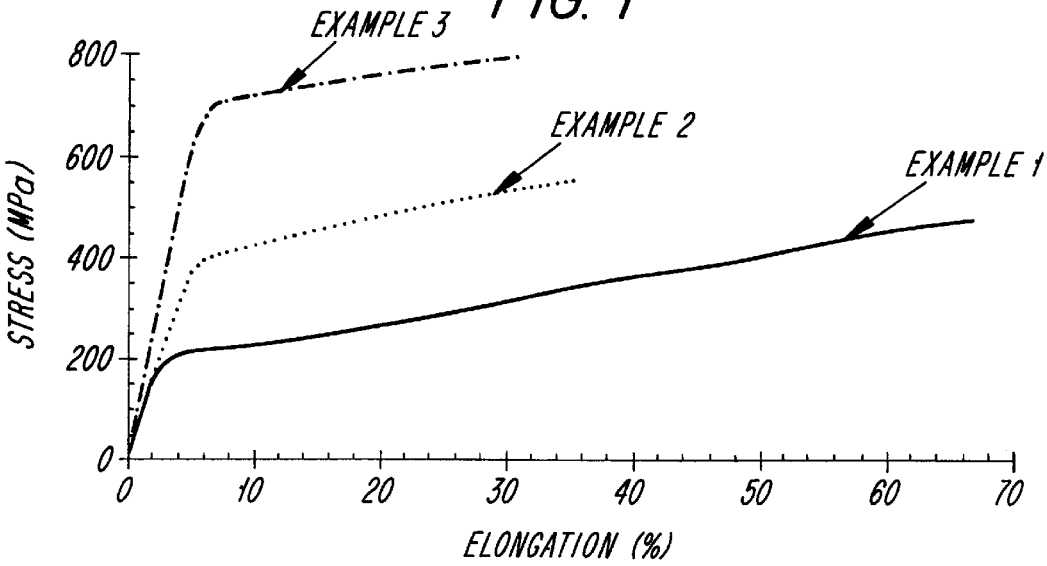
FIG. 1 represents the stress (in MPa)/elongation (in %) curves of the filaments of the invention and of a control filament of the prior art.

Preparation of Amorphous and Undrawn Poly(Ethylene Glycol Terephthalate) Filaments A poly(ethylene glycol terephthalate) with a viscosity index (VI) equal to 74 is extruded through a die, with a polymer throughput in the die of 500 g/min, at a temperature of 282° C. in the form of filaments with a round cross-section. The filaments are cooled at the die outlet with water and wound onto a bobbin at the rate of 54 m/min.

The filament obtained has the following properties:

Diameter: 510 $\mu$m

Tg=75° C.

Total birefringence $\Delta n$ of less than $10^{-4}$

Elongation at break of greater than 400%

These filaments are used as starting materials in the tests described below.

EXAMPLE 1

(Comparative and Control Test)

The undrawn monofilament described above is drawn in a drawing device by application of a constant force of 4 N (corresponding to a stress of 20 MPa with respect to the initial cross-section with a diameter of 510 $\mu$m). The filament is brought to temperature by heating in a hot-air oven. The drawing temperature is 130° C. (Tg+55° C.). The filament is drawn to the limit, the draw ratio being 4.2.

The characteristics of the filament are:

Degree of crystallinity: 35%

$\Delta n$=0.157, for a $\Delta n_0$=0.23

Young's modulus=7.6 GPa

Stress at 2%=155 MPa

Stress at 5%=205 MPa

Breaking stress=480 MPa

Elongation at break=70%

The stress/elongation curve of this filament is the curve 1 of the graph represented in FIG. 1.

The limits of the elastic range for this material are:

Stress=150 MPa

Elongation=1.9%

EXAMPLE 2

Filament in Accordance With the Invention

The undrawn filament described above is subjected to a two-stage drawing operation in accordance with the process of the invention.

The first drawing stage is carried out by heating the filament to a temperature of 136° C. (Tg+61° C.) and application of a draw ratio of 1.7.

The structural characteristics of the predrawn filament are:

$\Delta n$=0.00047

No crystallinity detectable

This predrawn filament is subjected, in a second stage, to a drawing operation under conditions analogous to those used in Example 1. The drawing force is 2.40 N (i.e. a stress of 20 MPa over an initial cross-section with a diameter equal to 390 $\mu$m).

Under these conditions, the maximum draw ratio is 5.5 (increase of 30% with respect to the ratio applied in Example 1). The overall draw ratio is 9.35 (1.7×5.5).

The structural characteristics of the filament are:

Degree of crystallinity: 35%

$\Delta n$=0.188, for $\Delta n_0$=0.23

The mechanical characteristics are:

Young's modulus=8.5 GPa

Stress at 2%=170 MPa

Stress at 5%=370 MPa

Breaking stress=555 MPa

Elongation at break=35%

The stress/elongation curve of this filament is the curve 2 of the graph represented in FIG. 1.

The limits of the elastic range for this filament are:

Stress=340 MPa

Elongation=4.4%

EXAMPLE 3

Filament in Accordance With the Invention

An undrawn filament described above is drawn according to the same procedure as that of Example 2. However, the draw ratio applied in the first stage is 2.15 instead of 1.7.

The structural characteristics of the predrawn filament are:

$\Delta n$=0.00055

No crystallinity detectable

The second drawing operation is carried out under the same conditions with a force of 1.85 N (i.e. a stress of 20 MPa over an initial cross-section with a diameter of 350 $\mu$m).

Under these conditions, the maximum draw ratio is 5.95. The overall draw ratio is 12.8.

The structural characteristics of the filament after the second drawing operation are:

Degree of crystallinity: 31%

$\Delta n$=0.193, for $\Delta n_0$=0.23

The mechanical characteristics are:

Young's modulus=13.0 GPa

Stress at 2%=270 MPa

Stress at 5%=610 MPa

Breaking stress=750 MPa

Elongation at break=31%

The stress/elongation curve of this filament is the curve 3 of the graph represented in FIG. 1.

The limits of the elastic range for this material are:

Stress=610 MPa

Elongation=5.0%

Figure 2:
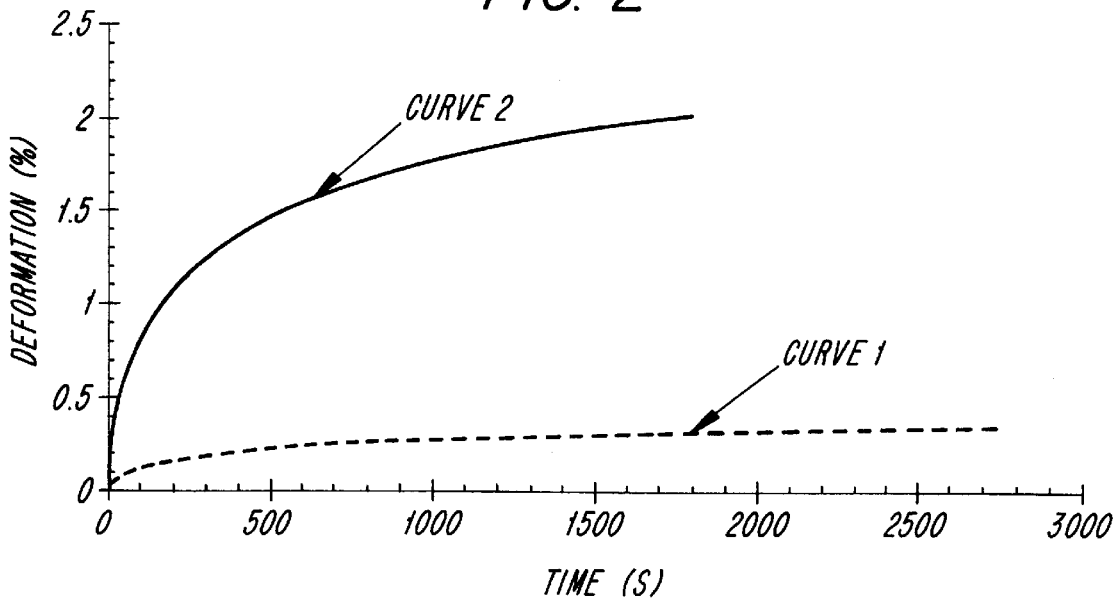
FIGS. 2 and 3 represent the non-instantaneous deformations of the filaments of the invention and of a control filament of the prior art at 25° C. and 160° C. respectively.
Figure 3:
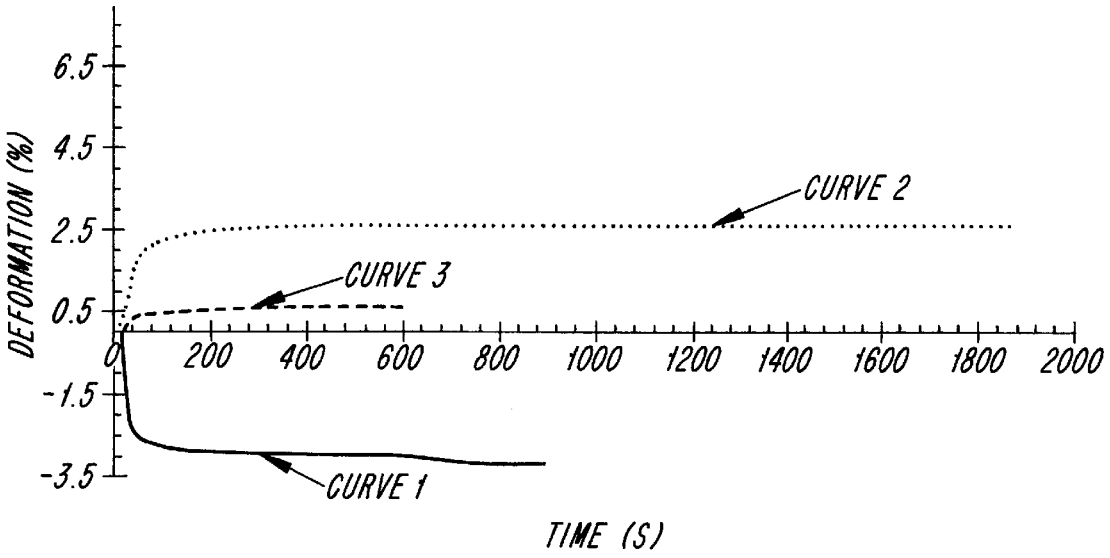

FIGS. 2 and 3 illustrate the non-instantaneous deformations at 25° C. and 160° C. respectively of the drawn filament of Example 3 in accordance with the invention in comparison with a filament obtained according to a conventional industrial process for the manufacture of a monofilament.

At 25° C., the monofilament of the invention (curve 1) undergoes a slight deformation which remains substantially constant, even after 2500 s under a load of 200 MPa. In contrast, the monofilament obtained according to a conventional process (curve 2) undergoes a significant deformation which continues to increase, with a load exclusively of 100 MPa.

An improvement in the properties of resistance to creep of the monofilament of the invention is also demonstrated by the curves of FIG. 3, representing the non-instantaneous deformations observed at 160° C. for the monofilament of Example 3 and a conventional monofilament. Thus, under a load of 20 MPa, no deformation of the monofilament in accordance with the invention is observed (curve 1). The conventional monofilament exhibits a deformation of 2.5% at this temperature and under this load (curve 2). The curve 3 shows that, under a load of 100 MPa, the monofilament of Example 3 only deforms by approximately 0.5%.

Furthermore, the stress/elongation curves clearly illustrate that the elastic range of the filaments drawn according to the process of the invention is markedly greater than the elastic range of the other filaments drawn according to a conventional process.

This characteristic is of use in particular in the application of textile surfaces or screen printing screens.

In addition, the application of the two-stage drawing process in accordance with the invention makes it possible to apply draw ratios which are markedly greater than those which can be applied with known drawing processes. These higher draw ratios make it possible to obtain filaments exhibiting, in addition to a greater elastic range, higher mechanical properties.

The temperatures and forces given in the examples depend on the nature of the polymer used. Thus, with a copolyester or another polymer with a different Tg, they can be different, without on that account departing from the scope of the invention.

Furthermore, the drawing operations were carried out with a constant force. This type of drawing operation is representative of industrial drawing processes between rollers. The value of this force, which is 20 MPa (nominal stress with respect to the surface area of the initial cross-section of the filament), is also representative of the stress values applied in industrial processes (resulting draw ratio of the order of 4).

EXAMPLE 4

Filament in Accordance With the Invention

A test of the manufacture of polyester filaments on an industrial continuous drawing and heat-setting plant was carried out.

This plant comprises two roller drawing devices arranged in line and separated by an oven, in order to adjust the temperature of the filament in each drawing region, and then a stage of relaxation or heat-setting of the filament comprising an oven and rollers which determine the rate of forward progression of the filament.

The filament is brought to temperature in the various stages above by passing the filament into an oven before each drawing or heat-setting stage. The temperature of the ovens is determined experimentally and depends on the equipment and the technology used. For the test in accordance with the invention, the temperature of the oven before the first drawing stage was set in order to obtain a temperature of the filament in accordance with the invention.

A test of manufacturing a filament according to a conventional drawing process was carried out by drawing a poly(ethylene terephthalate) filament comprising 0.4% by weight of titanium oxide.

A ratio of 4.64 was applied in the first drawing region and then a ratio of 1.25 in the second region (total drawing ratio is 5.8). The filament was subsequently relaxed according to a degree of 20%.

An identical filament was drawn with the same plant according to the process of the invention. Thus, the draw ratio applied in the first drawing region is 1.7 and this ratio is 4.41 in the second region (the total draw ratio is 7.5). A degree of relaxation of 20% was also applied.

The properties of these two filaments are combined in the table below.

| Characteristics | Filament obtained according to a conventional drawing process | Filament obtained according to the process of the invention |
|---|---|---|
| Count (dtex) | 2700 | 2230 |
| Elongation at break (%) | 32.4 | 31.5 |
| Breaking stress (MPa) | 665 | 805 |
| Shrinkage at 160° C. (%) | 0.5 | −0.5 |

These characteristics were determined according to the methods described above but on a sample with a length of 250 mm and a rate of 250 mm/min.

These results show the high level of breaking stress of the filament in accordance with the invention for a similar elongation at break. This increase is of the order of 20%.

Results analogous to those obtained with such a process will be produced by drawing processes carried out with other stress values or under a non-constant force.

We claim:

1. Filament comprising a melt spun and drawn semicrystalline polyester, wherein said filament has an elastic range having stress/elongation limits such that stress is 300 MPa or greater at an elongation of 4% or greater.

2. Filament according to claim 1, having an elastic range having stress/elongation limits such that stress is 600 MPa or greater at an elongation of 5% or greater.

3. Filament according to claim 1 or 2, which exhibits a non-instantaneous deformation at 25° C. under a stress of 200 MPa after 2500 s of less than 1%.

4. Filament according to claim 1, which exhibits a non-instantaneous deformation at 160° C. under a stress of 100 MPa of less than 2% after 600 s.

5. Filament according to claim 1, which exhibits a stress of greater than 350 MPa for an elongation of 5%.

6. Filament according to claim 1, which exhibits a Young's modulus of greater than 9 GPa and a breaking stress of greater than 700 MPa for an elongation at break of greater than 25%.

7. Filament according to claim 1, wherein the semicrystalline polyester is a poly(ethylene terephthalate) or a copolymer comprising at least 80% of ethylene glycol terephthalate units.

8. Filament according to claim 1, wherein the semicrystalline polyester is a poly(ethylene glycol terephthalate).

9. Filament according to claim 3, which exhibits a non-instantaneous deformation at 25° C. under a stress of 200 MPa after 2500 s of less than 0.5%.

10. Filament according to claim 4, which exhibits a non-instantaneous deformation of 160° C. under a stress of 100 MPa of less than 1% after 600 s.

11. Filament according to claim 6, which exhibits a Young's modulus of greater than 12 GPa and a breaking stress of greater than 700 MPa for an elongation at break of greater than 25%.

* * * * *